US007007734B1

(12) United States Patent
Poffenbarger et al.

(10) Patent No.: US 7,007,734 B1
(45) Date of Patent: Mar. 7, 2006

(54) TELESCOPING SUPPORT ARM MANAGEMENT DEVICE FOR AWNINGS AND METHOD

(76) Inventors: Robert Merlin Poffenbarger, 202 50th ave Ter. East, Bradenton, FL (US) 34203; Bertha Mae Poffenbarger, 202 50th ave. Ter. East, Bradenton, FL (US) 34203

( * ) Notice: Subject to any disclaimer, the term of this patent is extended or adjusted under 35 U.S.C. 154(b) by 30 days.

(21) Appl. No.: 10/949,606

(22) Filed: Sep. 27, 2004

(51) Int. Cl.
*E04F 10/06* (2006.01)

(52) U.S. Cl. ..... 160/71; 160/80

(58) Field of Classification Search ..... 160/71, 160/66, 67, 68, 69, 70, 78, 80, 22, 55, 58.1, 160/405; 135/88.11, 88.12; 24/545
See application file for complete search history.

(56) References Cited

U.S. PATENT DOCUMENTS 2,092,508 A * 9/1937 Hammar ..... 40/620
2,542,737 A * 2/1951 Vogel ..... 220/696
3,612,145 A * 10/1971 Darula et al. ..... 160/67
5,369,850 A * 12/1994 Noble ..... 24/335
5,909,761 A * 6/1999 Murray ..... 160/71
6,125,905 A * 10/2000 Woodside et al. ..... 160/67
6,179,513 B1 * 1/2001 Marasco ..... 403/374.5
6,598,612 B1 * 7/2003 Crowe ..... 135/88.12

* cited by examiner

*Primary Examiner*—David Purol
(74) *Attorney, Agent, or Firm*—Dorothy S. Morse, Esq.

(57) ABSTRACT

A device that allows one person working alone to easily raise and lower fold-down awnings. It is secured to the underside surface of the awning in a position to receive one of the awning's telescoping support arms and maintain it in a fixed position against the awning, for faster and easier handling of the awning while it is being lowered and raised. It has a U-shaped construction, with a central space in which to hold a telescoping support arm, a narrowed area adjacent to the central space to restrict downward movement of the telescoping support arm out of the central space, opposing flared ends that help to guide a telescoping support arm through the narrowed area and into the central space, and at least one fastener hole. Although aluminum materials are preferred, the present invention device can be made from other non-corroding materials, such as but not limited to plastic.

6 Claims, 1 Drawing Sheet

TELESCOPING SUPPORT ARM MANAGEMENT DEVICE FOR AWNINGS AND METHOD

CROSS-REFERENCES TO RELATED APPLICATIONS

None.

BACKGROUND OF THE INVENTION

1. Field of the Invention

This invention relates to the field of fold-down awnings, specifically to a device that allows an individual to easily lower large and small awnings without assistance.

2. Description of the Related Art

Rigid fold-down awnings made from aluminum are commonly used to shade the windows of mobile homes. Smaller ones shade a single window, while larger ones can protect two, three, and even four consecutively positioned windows. Fold-down awnings typically have a pivoting connection on their proximal ends, above the protected window or windows, so that they can be raised and lowered. When each such awning is raised, at least two telescoping support arms are connected between the extended end of the awning and a mounting bracket or plate on the mobile home wall beneath the protected window or windows. When such an awning is lowered, the telescoping support arms that are each pivotally connected to the free end of the awning, are rotated upwardly and hidden in out-of-the-way positions between the awning and the mobile home wall, where they are readily available for placing the awning into a raised position again. Awnings large enough to shade four consecutively positioned windows have five telescoping support arms that must be independently manipulated when the awning is lowered or raised. Thus, at least two people are usually required to accomplish the task, with at least one person slightly lifting the free end of the awning so that the pins holding the telescoping arms from a mounting bracket or plate can be released, while the other person or persons one-at-a-time frees the pins and holds each of the telescoping support arms in an upwardly extending position which allows the awning to drop under the influence of gravity into a lowered position, with the telescoping support arms each becoming hidden behind the lowered awning. While raising large awnings can also require more than one person, lowering an awning is particularly difficult for one person to accomplish alone. The present invention facilitates the process of raising and lowering the fold-down type of awnings attached to mobile homes so that one adult of average strength can easily accomplish the task alone.

BRIEF SUMMARY OF THE INVENTION—OBJECTIVES AND ADVANTAGES

The primary object of this invention is to provide several of the present invention devices in spaced-apart positions on the underside surface of a fold-down awning where each device is able to secure one of the awning's telescoping support arms in a fixed position against the awning while it is being raised or lowered, so that any adult of average strength is able to easily raise or lower the awning alone. It is also an object of this invention to provide a telescoping support arm management device that is sturdy and made from non-corroding materials for extended use outdoors. It is a further object of this invention to provide a telescoping support arm management device that is easily connected to the underside surface of the awning for rapid installation.

When the present invention is properly manufactured and installed for use, it is secured to the underside surface of a fold-down awning in an orientation and location to receive a telescoping support arm and maintain it in a fixed position against the awning while the awning is being raised and lowered, for faster and easier handling of the awning. The present invention device has a simple and generally U-shaped construction, with an adequately sized central space in which to temporarily hold a telescoping support arm, a narrowed area adjacent to the central space to restrict downward movement of the telescoping support arm out of the central space, opposing flared ends that help to guide a telescoping support arm through the narrowed area and into the central space, and at least one fastener hole centrally within the U-shaped configuration for connection of the device to one of the laterally extending support bars on the underside surface of the awning. Although aluminum materials are preferred, the present invention device can be made from other non-corroding materials, such as but not limited to plastic. Also, it is contemplated for the fastener used with the present invention to have an oversized head for ease of installing the present invention to an awning. There is no telescoping support arm management device known with the same features and function as the present invention, nor all of its advantages.

While the description herein provides preferred embodiments of the present invention, it should not be used to limit its scope. For example, variations of the present invention, while not shown and described herein, can also be considered within the scope of the present invention, such as variations in the size of the size of the fastener hole used; the width dimension of the narrowed area adjacent to the central space; the thickness and type of material used for the present invention, and the length of the flared ends used to guide a telescoping support arm through the narrowed area and into the central space. Thus, the scope of the present invention should be determined by the appended claims and their legal equivalents, rather than being limited to the examples given.

DETAILED DESCRIPTION OF THE INVENTION

Figure 1:
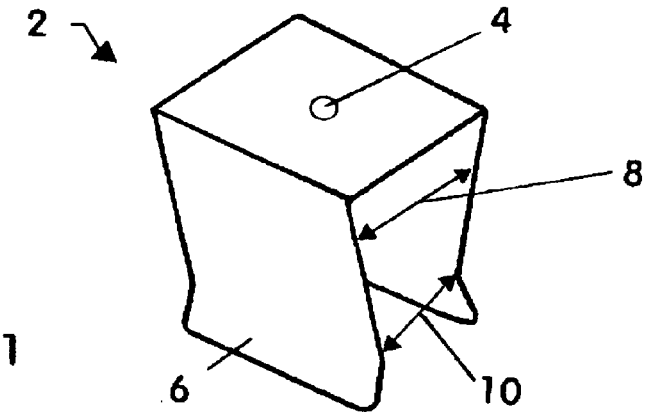
FIG. 1 is a perspective view of the most preferred embodiment of the present invention.
Figure 2:
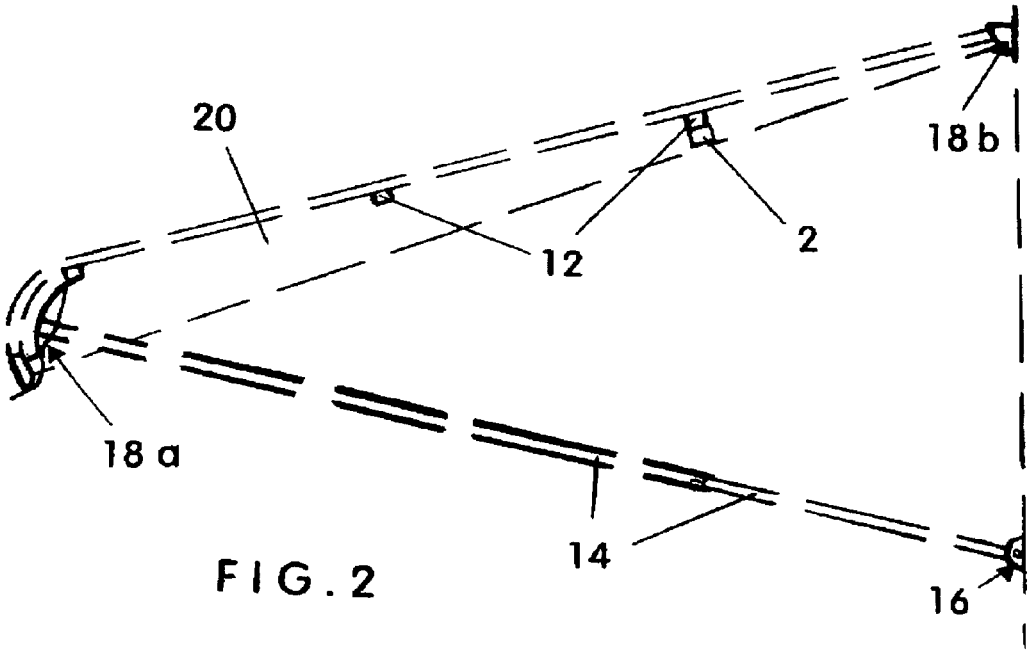
FIG. 2 is a side view of the most preferred embodiment of the present invention in its usable position connected to a horizontal support bar on the underside of an awning.

FIG. 1 shows the most preferred embodiment 2 of the present invention close to actual size, while FIG. 2 shows it in its usable position connected to a horizontal support bar 12 on the underside of a fold-down awning 20. FIG. 1 shows most preferred embodiment 2 having a simple and generally U-shaped construction, with an adequately sized central space 8 in which to temporarily hold a telescoping support arm (identified in FIG. 2 by the number 14), a narrowed area 10 adjacent to central space 8 to restrict downward movement of the telescoping support arm 14 out of central space 8, opposing flared ends 6 that help to guide a telescoping support arm 14 through narrowed area 10 and into central space 8, and at least one fastener hole 4 centrally within the U-shaped configuration for connection of most preferred embodiment 2 to one of the laterally extending support bars 12 on the underside surface of awning 20. Although aluminum materials are preferred, most preferred embodiment 2 can be made from other non-corroding materials, such as but not limited to plastic. Also, it is contemplated for the fastener (not shown) used with most preferred embodiment 2 to have an oversized head for ease of installing most preferred embodiment 2 to awning 20. Variations in different embodiments of the present invention can include but are not limited to the size of the size of the fastener hole 4 used; the width dimension of the narrowed area 10 adjacent to central space 8; the thickness and type of material used for the present invention, and the length of the flared ends 6 used to guide a telescoping support arm 14 through narrowed area 10 and into central space 8. Also, although the U-shaped preferred embodiment 2 shown in FIG. 1 has an angular construction, it may also have a rounded or oval appearance, or include a central space 8 having any curvilinear perimeter configuration that would allow it to fulfill its intended function. Although not limited to, the following dimensions for the present invention are preferred. For the most commonly anticipated applications, it is contemplated for central space 8 to have a maximum width dimension of approximately one inch, as well as length and height dimensions of approximately one-and-one-fourth inches, for narrowed area 10 to have a width dimension that is approximately five-eighths of an inch, and for flared ends 6 to each have a length dimension that is approximately three-eighths of an inch.

To lower an awning attached to a mobile home, such as awning 20 in FIG. 2, one would pull the pins (not shown) on the distal ends of the telescoping support arms 14 one-at-a-time from its associated mounting bracket or plate 16 located on the mobile home wall. As the distal end of each telescoping support arm 14 in succession is freed and the outer end of awning 20 is thereafter slightly raised through use of the pivoting connection 18*b* located between the proximal end of awning 20 and the mobile home wall, the telescoping support arm 14 is then lifted upward through use of the pivoting connection 18*a* located between telescoping support arm 14 and distal end of awning 20 and secured into one of the present invention devices 2 attached to the underside of a horizontally extending support bar 12 connected to the underside of awning 20. When all of the telescoping support arms 14 have been successfully secured into different present invention devices, awning 20 is then lowered to against the mobile home wall. Only one present invention device is required for each telescoping support arm 14. When there is more than one horizontal support bar 12 on the underside of an awning 20, as shown in FIG. 2, it is preferred that the present invention device be attached to one that would allow it to secure the distal half of a telescoping support arm 14, and not its proximal half. Using the above procedure and multiple present invention devices, one person of average strength is able to raise or lower a four-window awning 20 having five telescoping support arms. Without the present invention device it would take at least three people to lower the same four-window awning 20. While it is helpful for the person raising and lowering a four-window awning 20 with the present invention to be in good physical condition, age is not a limiting factor as the present invention has been successfully tested by people in their seventies, who were able to easily accomplish the task alone.

We claim:

1. A method of lowering a fold-down awning, said method comprising the steps of:

providing a generally U-shaped member with a central space dimensioned to hold a telescoping support arm of an awning, a narrowed area adjacent to said central space that is configured to restrict downward movement of the telescoping support arm out of said central space, opposing flared ends configured to help to guide a telescoping support arm through said narrowed area and into said central space, a fold-down awning having a laterally extending support bar and a telescoping support bar, and at least one fastener hole centrally through said U-shaped member;

also providing fastening means;

using said fastening means to secure said U-shaped member to said laterally extending support bar with said opposing flared ends facing said telescoping support bar so that said member assists one person in being able to raise and lower the awning alone.

2. The method of claim 1 wherein said member is made from materials selected from a group consisting of non-corroding materials, plastics, and aluminum.

3. The method of claim 1 wherein said central space has a maximum width dimension of approximately one inch, with length and height dimensions each being approximately one-and-one-fourth inches.

4. The method of claim 3 wherein said narrowed area has a width dimension that is approximately five-eighths of an inch.

5. The method of claim 4 wherein said flared ends each have a length dimension that is approximately three-eighths of an inch.

6. The method of claim 1 wherein said fastening means comprises at least one fastener with an oversized head.

* * * * *